US010527249B2

(12) United States Patent
Thombre

(10) Patent No.: US 10,527,249 B2
(45) Date of Patent: Jan. 7, 2020

(54) VEHICLE LAMP AND PROJECTION LENS

(71) Applicant: North American Lighting, Inc., Paris, IL (US)

(72) Inventor: Ashwin Thombre, Farmington Hills, MI (US)

(73) Assignee: NORTH AMERICAN LIGHTING, INC., Paris, IL (US)

( * ) Notice: Subject to any disclaimer, the term of this patent is extended or adjusted under 35 U.S.C. 154(b) by 0 days.

(21) Appl. No.: 15/994,739

(22) Filed: May 31, 2018

(65) Prior Publication Data

US 2019/0368678 A1 Dec. 5, 2019

(51) Int. Cl.

| | |
|---|---|
| ***F21S 41/00*** | (2018.01) |
| ***F21S 41/275*** | (2018.01) |
| ***F21S 43/50*** | (2018.01) |
| ***F21S 41/36*** | (2018.01) |
| ***F21S 41/33*** | (2018.01) |
| ***F21S 41/141*** | (2018.01) |

(52) U.S. Cl.

CPC ..... *F21S 41/275* (2018.01); *F21S 41/141* (2018.01); *F21S 41/33* (2018.01); *F21S 41/36* (2018.01); *F21S 43/50* (2018.01)

(58) Field of Classification Search

CPC .. F21S 43/40; F21S 43/20; F21S 43/26; F21S 41/275; F21S 41/26; F21S 41/265

See application file for complete search history.

(56) References Cited

U.S. PATENT DOCUMENTS

| | | | | |
|---|---|---|---|---|
| 6,164,799 | A * | 12/2000 | Hirmer | G02B 6/0048 362/330 |
| 7,685,886 | B2 | 3/2010 | Sano et al. | |
| 8,061,880 | B2 * | 11/2011 | Lambert | B60Q 1/0041 362/511 |
| 8,820,992 | B2 * | 9/2014 | Wilson | F21S 41/24 362/511 |
| 2004/0141323 | A1 * | 7/2004 | Aynie | F21V 7/0091 362/308 |
| 2006/0044825 | A1 | 3/2006 | Sa | |
| 2010/0246200 | A1 * | 9/2010 | Tessnow | G02B 6/0075 362/509 |
| 2011/0058385 | A1 * | 3/2011 | Kazaoka | B60R 1/1207 362/540 |
| 2012/0224385 | A1 * | 9/2012 | Godbillon | G02B 6/001 362/511 |
| 2012/0250343 | A1 * | 10/2012 | Koizumi | F21S 43/14 362/511 |
| 2013/0021815 | A1 * | 1/2013 | Koizumi | F21S 43/14 362/511 |
| 2014/0252249 | A1 | 9/2014 | Doros et al. | |

(Continued)

*Primary Examiner* — Gerald J Sufleta, II

(74) *Attorney, Agent, or Firm* — Brooks Kushman P.C.

(57) ABSTRACT

A vehicle lamp is provided with a projection lens having a lens profile with a rear major surface with a convex curvature and a front surface with a concave curvature. A rear height of the rear major surface is greater than a front height of the front surface. The lamp has a plurality of light sources 36 and a reflector configured to reflect the light emitted from the plurality light of sources towards the projection lens. As the lens profile is swept along a curve length, at least one of the rear convex curvature or the front concave curvature varies. The light output from the front surface of the projection lens is generally uniform along the curve length.

15 Claims, 4 Drawing Sheets

(56) References Cited

U.S. PATENT DOCUMENTS

| | | | | |
|---|---|---|---|---|
| 2017/0211775 | A1 | 7/2017 | Potter et al. | |
| 2017/0291531 | A1 | 10/2017 | Park | |
| 2018/0347776 | A1* | 12/2018 | Matsuda | F21S 41/26 |
| 2019/0003676 | A1* | 1/2019 | Franc | F21S 43/245 |
| 2019/0017670 | A1* | 1/2019 | Zhu | F21S 41/00 |
| 2019/0072252 | A1* | 3/2019 | Moser | F21V 11/186 |

* cited by examiner

VEHICLE LAMP AND PROJECTION LENS

TECHNICAL FIELD

The present disclosure relates to a lens for a vehicle lamp.

BACKGROUND

Vehicles include various lamps and provide numerous functions such as illuminating surroundings, improving a driver's visibility or indicating intended direction of travel. Vehicle styling and packaging often dictate shape and geometry of the vehicle lamp. Regardless of lamp styling, functional requirements and government regulations must still be met.

SUMMARY

According to at least one embodiment, a vehicle lamp is provided with a projection lens having a lens profile with a rear major surface with a convex curvature and a front surface with a concave curvature. A rear height of the rear major surface is greater than a front height of the front surface. The lamp has a plurality of light sources 36 and a reflector configured to reflect the light emitted from the plurality light of sources towards the projection lens. As the lens profile is swept along a curve length, at least one of the rear convex curvature or the front concave curvature varies. The light output from the front surface of the projection lens is generally uniform along the curve length.

In another embodiment, the front height is less than a profile thickness between the rear major surface and the front surface.

In another embodiment, a profile thickness between the rear major surface and the front surface is generally constant.

In another embodiment, a profile thickness between the rear major surface and the front surface varies along the curve length.

In another embodiment, the front height is generally constant along the curve length.

In another embodiment, the curve length has at least one of a rake curvature and a sweep curvature.

In another embodiment, the convex curvature extends in a height direction, wherein the major rear surface further comprises a plurality of tailored contours extending in a length direction of the curve length.

In another embodiment, the plurality of tailored contours is shaped as a plurality of scallops.

In another embodiment, the plurality of light sources comprises a plurality of light emitting diodes (LEDs) spaced apart in a length direction of the curve length.

In another embodiment, the reflector comprises a plurality of reflectors, wherein one of the reflectors is positioned adjacent each of the LEDs.

In another embodiment, the central optical axis of radiation from each of the reflectors is generally parallel along the curve length.

According to at least one other embodiment, a projection lens is provided. The projection lens has a lens profile having a convex rear surface and a concave front surface. The lens profile sweeps along a curve length. At a first length position the convex rear surface has a first convex curvature. The convex rear surface has a second convex curvature different from the first convex curvature at a second length position oriented at one of a sweep angle or rank angle from the first length position.

In another embodiment, a front surface height is less than a rear surface height along the curve length.

In another embodiment, the lens profile height decreases from the convex rear surface to the concave front surface.

According to at least one other embodiment, a vehicle lamp is provided having a light blade. The light blade has a convex rear surface to redirect and reshape a light input towards a concave front surface. The light blade has a front height less than a rear height. A light source is disposed rearward of the light blade. A reflector is configured to reflect light emitted from the light source towards the light blade. A light output from the concave front surface of the light blade is generally uniform along a blade length.

In another embodiment, a convex curvature of the rear convex surface varies along the blade length while a concave curvature of the concave front surface remains constant.

In another embodiment, the blade length has at least one of a rake curvature and a sweep curvature.

In another embodiment, the front height is less than a profile thickness between the convex rear surface and the concave front surface.

DETAILED DESCRIPTION

As required, detailed embodiments of the present invention are disclosed herein;

however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Automotive lighting, such as headlamps or signal lamps, have increasingly styled features and design. These aesthetic designs must simultaneously meet federal automotive lighting regulations. One aesthetic design is the narrow, pencil-thin light ribbon that may be used in lamps for signal lighting functions or other lit portions of a vehicle lamp that require a thin illuminated strip of light.

Traditional lamp and lens designs limit the height of the light strip without suffering major efficiency losses. These efficiency losses prevent the light strip from being too thin. In order to overcome the efficiency losses with a thin light strip, a steep increase in input flux from the light source is required, which results in higher cost of the light source components and increased thermal concerns within the lamp structure.

Another challenge of thin light strip designs is providing uniform light output even when the styling requires aggressive contours along the length of the light strip. The styling may require the light strip to follow the rake and sweep contours of the vehicle, while still providing light output along a single optical axis.

Figure 1:
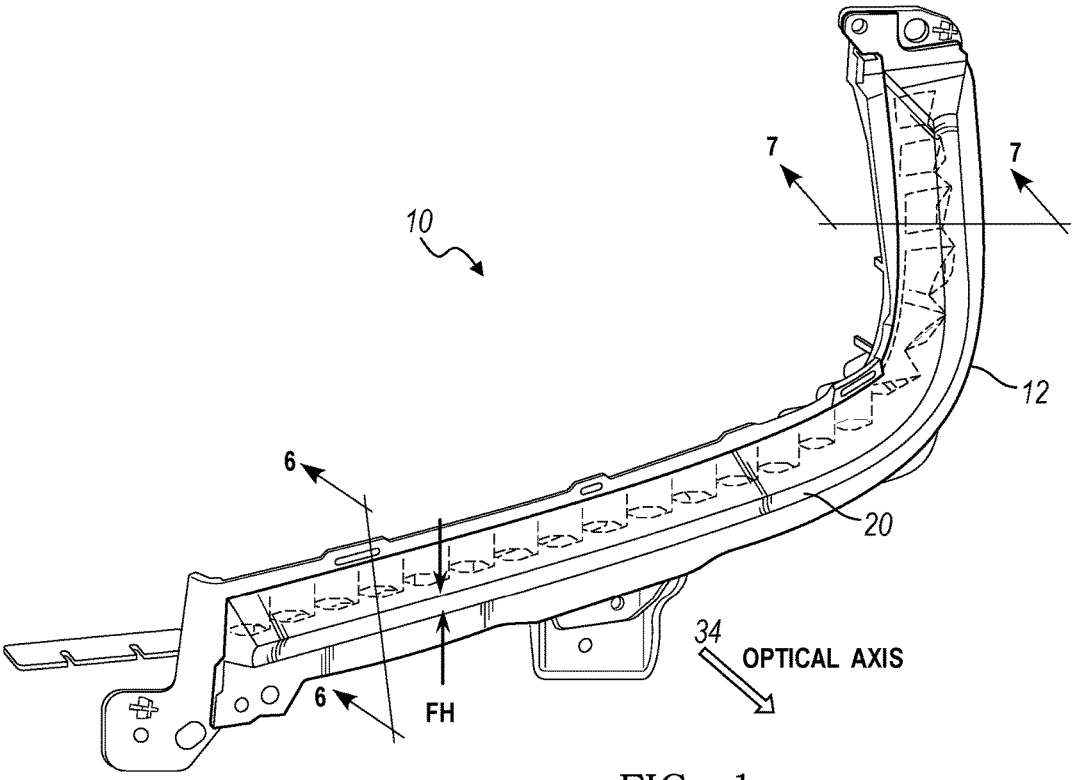
FIG. 1 is a front perspective view of the vehicle lamp having a projection lens according to one embodiment of the present disclosure.
Figure 2:
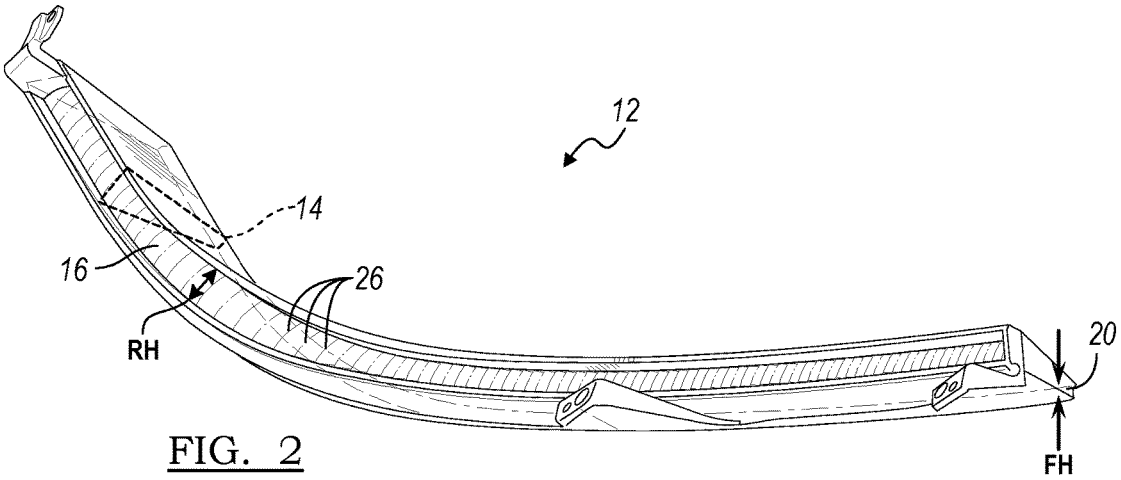
FIG. 2 is a rear perspective view of the projection lens in FIG. 1 with the lamp housing removed.
Figure 3:
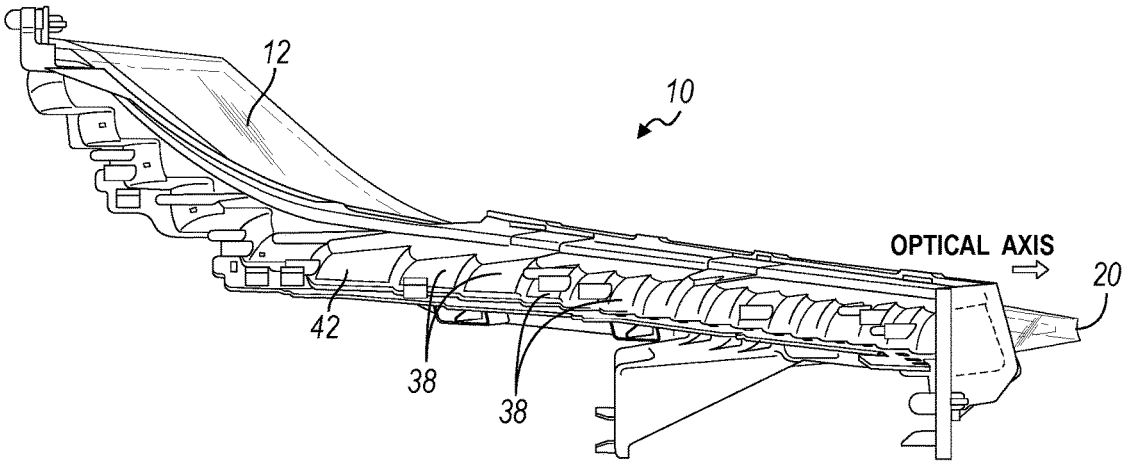
FIG. 3 is a perspective view of the vehicle lamp in FIG. 1.

FIGS. 1-3 illustrates a vehicle lamp 10 having a lens 12 formed as a light blade. The light blade lens 12 of the present disclosure has a thin forward opening 20 while still providing efficient and uniform light output along the length of the light blade lens 12.

As shown in FIG. 2, and described in more detail in FIGS. 4-8, the light blade lens 12 has a variable lens profile 14 with a rear major surface 16 having a convex curvature 30 and a front major surface 20 with a concave curvature 32.

Figure 5:
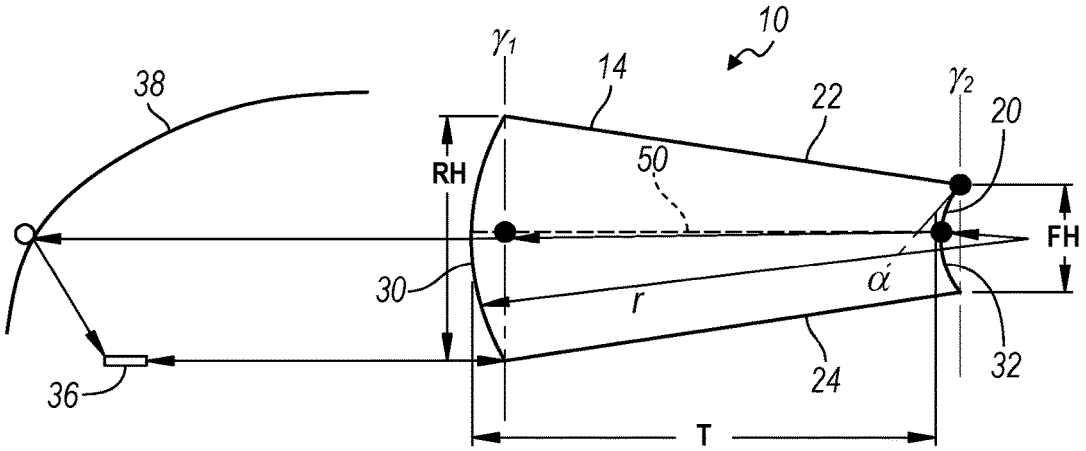
FIG. 5 is a schematic view of a vehicle lamp illustrating the lens profile.

A light source 36 is positioned rearward of the light blade lens 12. The vehicle lamp 10 also has a reflector 38 configured to reflect the light emitted from the light source 36 towards the lens 12. The reflector 38 may be a parabolic reflector configured to generally collimate light emitted from the light source 36 toward the lens 12. As shown in FIG. 5, the light source 36 may be positioned at a focal point of the reflector at a position between the reflector and the lens 12.

Figure 4:
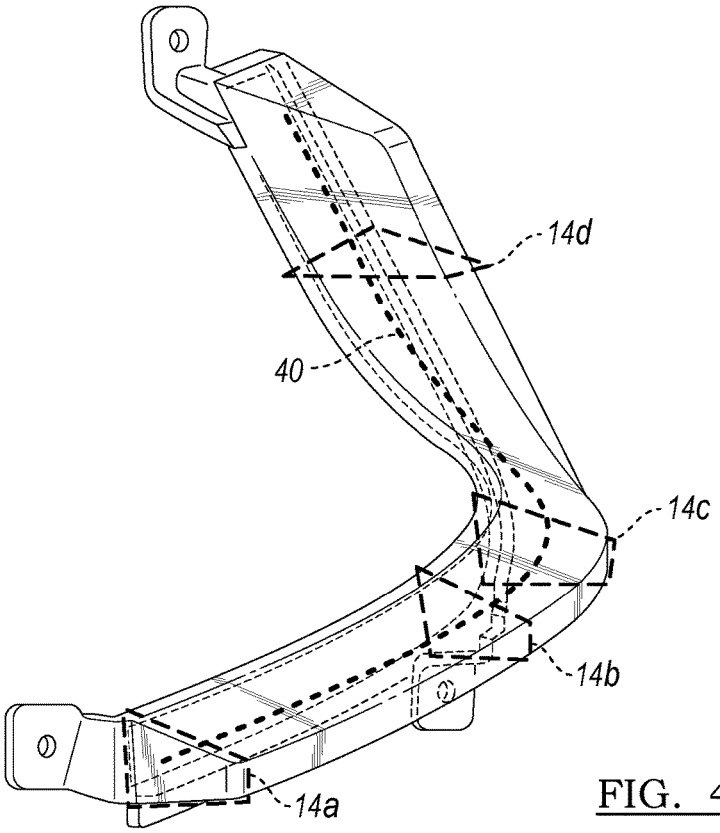
FIG. 4 is a perspective view of a lens profile along a curvature length.

The variable lens profile 14 has a rear height RH that is greater than a front height FH. To define the longitudinal shape of the light blade lens 12, the lens profile 14 is swept along a curve length 40, as shown in FIG. 4. The curve length 40 may be swept in three-dimensional space to define a thin elongated contour of the lens 12. For example, the curve length 40 may be swept along a rake angle or a sweep angle, where the rake angle is the deviation of the floor plane from a horizontal plane and sweep angle is the deviation of a central plane from a vertical plane. As shown in FIG. 4, the curve length 40 may be a complex contour line that forms a center line of each profile 14 and varies along rake and sweep angles simultaneously. Dimensions and characteristics of the lens profile 14 may vary along the curve length, discussed in more detail with reference to FIGS. 5-7. Lens profiles with varying dimensions are illustrated as 14*a*-14*d*.

As shown in FIG. 5, each lens profile 14 is defined by a first angled surface 22, shown as an upper surface, and a second angled surface 24, shown as a lower surface. The first and second angled surfaces 22, 24 may be defined by vehicle styling or lamp packaging requirements, for example. The lens profile height decreases from the convex rear surface 30 to the concave front surface 32.

In order to maintain generally uniform light output that is parallel to an optical axis 34 along the length 40, at least one lens parameter is varied along the curve length as the rake and sweep angles vary. FIG. 5 illustrates the various lens parameters of the light blade lens 12. Lens parameters such as the rear convex curvature 30 and front concave curvature 32 as well as the blade thickness T vary as the rake and sweep angles vary along the curve length 40 of the lens.

The rear height RH and front height FH of the lens 12 are a height dimension that is orthogonal to a central plane 50 of the lens 12. The rear height RH and front height FH may also be defined between the first and second angled surfaces 22, 24, at the rear surface 16 and at the front surface 20, respectively. The first and second angled surfaces 22, 24 converge so that the front height FH is less than the rear height RH and the front height FH defines the thin lit opening of the light blade lens 12.

The rear height RH may also define a rear chord of the rear curvature 30, and the front height FH may define a front chord of the front curvature 32 where a chord is a line segment joining two points on a curve.

The rear and front curvatures 30, 32 may be determined by iterating design variables until desired photometric performance and lit appearance is achieved. The convex rear curvature 30 is designed to collect and re-shape a collimated beam of light reflected from a reflector 38. The concave front curvature 32 maybe designed to have a desired light distribution and/or meet regulatory light intensity distribution requirements. For example, the convex and concave curvatures 30, 32 may be based on the constraint variables FH, RH and blade thickness T. An appropriate front-side tangency control angle $\alpha$ may be found iteratively to define the front side curvature of the thick blade which spreads the incoming tapering beam by the appropriate amount to meet regulatory and lit appearance requirements. Ray-traces are back-traced to locate an offset (x) of the light source from the reflector based on the package constraints of the lens 12. The shape of the reflector 38 can then be created to have the appropriate focal length (f) and left-right spread (s) along the curve length 40. The radius (r) of the rear convex curvature is created at each section based on the iterative ray tracing.

The convex curvature 30 extends in a height direction. The rear surface 16 may also include a plurality of tailored contours 26 extending in a length direction of the curve length, as shown in FIG. 2. The plurality of tailored contours 26 is shaped as a plurality of scallops. The scallops may be created by sweeping the convex curvature at a radius ($r_f$) that is out of plane with the variable lens profile 14.

The resulting lens 12 has profile where the front height FH is less than a profile thickness T between the rear surface 16 and the front surface 20. In addition, at least one of the rear convex curvature 30 or the front concave curvature 32 varies along the curve length 40 that curves is three-dimensional space in rake and sweep angles. As shown in the embodiment illustrated in FIG. 5, the thickness T is approximately 27 mm. The rear height RH is approximately 12 mm and the front height FH is approximately 7 mm or less. The reflector 38 is parabolic and has a focal length of approximately 8 mm. In another embodiment, the front height FR that defines the small lit opening may be in the range of 1 mm to 15 mm. In another embodiment, the front height FR may be in the range of 2 mm to 10 mm.

Figure 6:
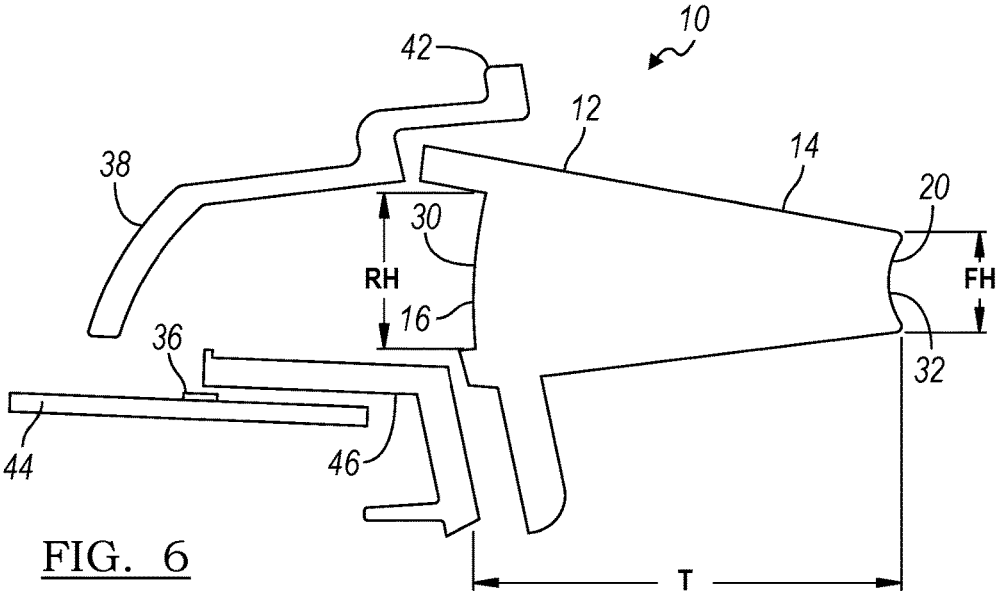
FIG. 6 is a section view through section 6-6 of the vehicle in FIG. 1.
Figure 7:
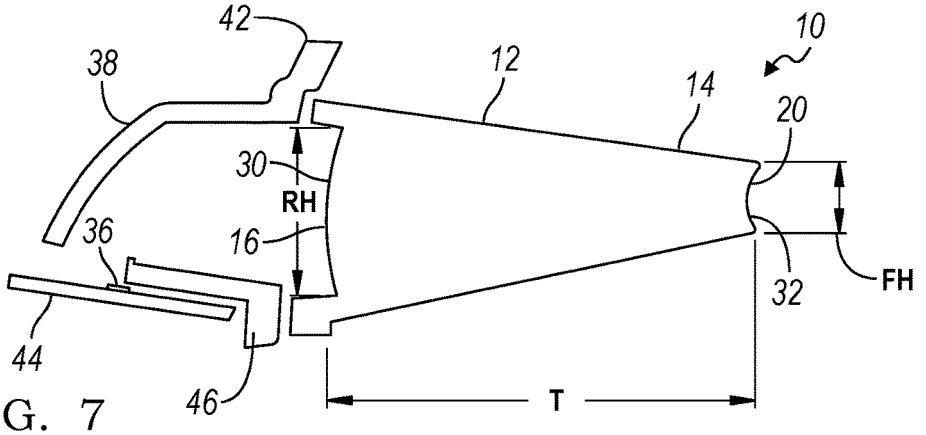
FIG. 7 is a section view through section 7-7 of the vehicle in FIG. 1.

FIGS. 6 and 7 illustrate the difference in cross-sections through the vehicle lamp 10 at two different positions along the curve length 40 of the lens 12. FIG. 6 shows a section view through section 6-6 of the lamp in FIG. 1 while FIG. 4 is a section view through section 7-7.

As shown in FIGS. 6 and 7, in this embodiment, the lens thickness T between the rear surface 16 and the front surface 20 may be generally constant along the curve length 40. The rear convex curvature in FIG. 6 has a different radius r than in FIG. 7. The front concave curvature 32 in FIG. 6 and FIG. 7 are different, and the front height FR is different in FIGS. 3 and 4.

In another embodiment, the profile thickness T between the rear surface 16 and the front surface 20 varies along the curve length 40. In another embodiment, the front height FH may be generally constant along the curve length 40 of the lens 12 while the rear height RH varies along the curve length 40.

FIGS. 6 and 7 illustrate the lamp having a plurality of light sources 36. Each of the light sources is a light emitting diode (LED) or another suitable light element. The light sources 36 are spaced apart in a length direction of the curve length 40. The lamp 10 has a plurality of reflectors 38, where one reflector 38 is associated with each light source 36. The focal length (I) and spread (s) of each reflector 38 varies along the curve length.

As shown in FIGS. 1 and 3, the reflectors 38 are formed in a lamp housing 42 mounted adjacent to the rear surface 16 of the lens 12. While FIG. 3 shows the side-rear perspective of the lamp housing 42, the varying dimensions of each of the reflectors 38 is illustrated. An electrical board 44 may also be mounted in the lamp housing 42 and the light source 36 is mounted to the electrical board 44, as illustrated in FIGS. 6-7. A shade 46 for blocking direct light from the light source 36 is also attached to the housing 42.

Figure 8:
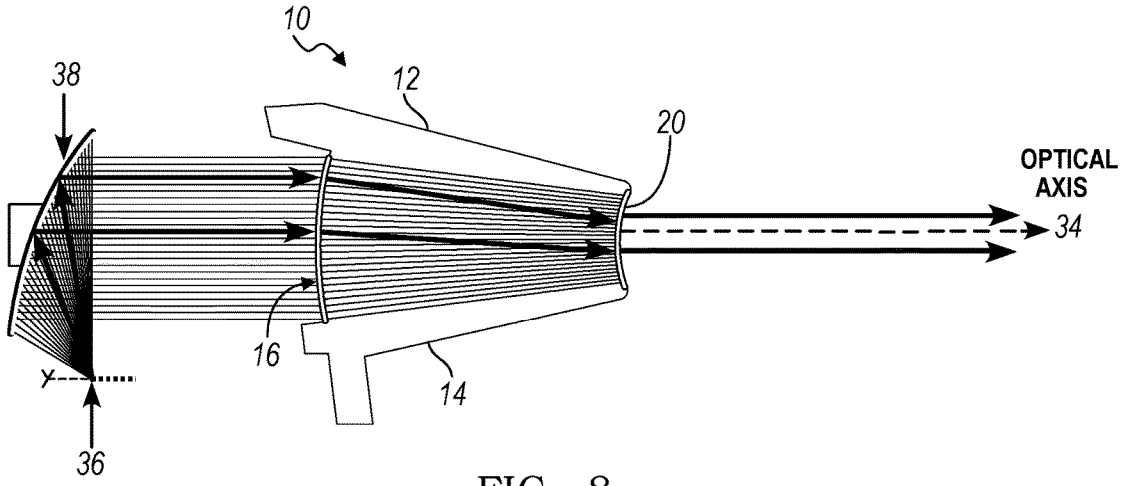
FIG. 8 is a schematic view of the vehicle lamp of FIG. 1 showing a ray trace.
Figure 9:
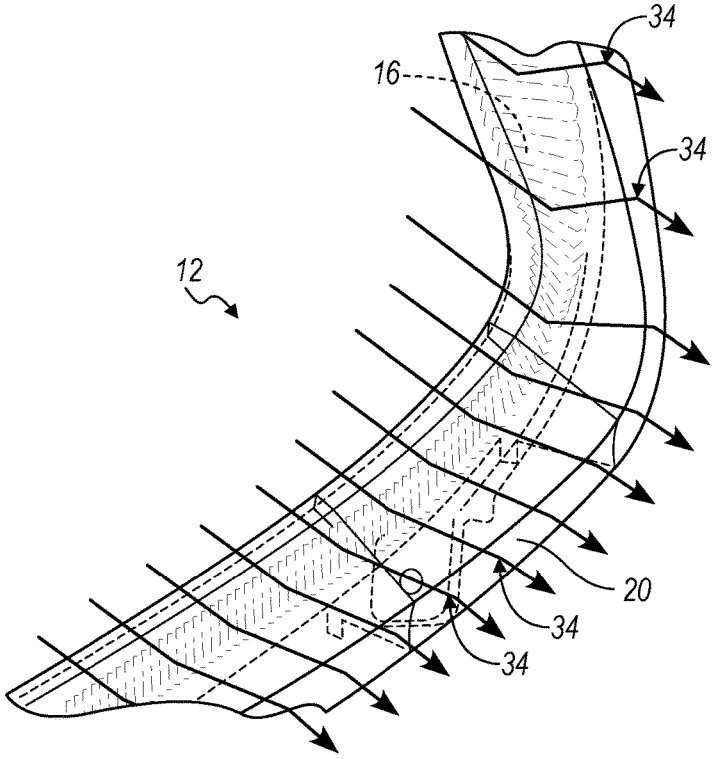
FIG. 9 is a schematic view of a portion of the profile lens of FIG. 2 showing the optical axis.

FIG. 8 is a schematic view of the vehicle lamp 10 with a light ray trace. The convexo-concave lens with optical convex rear surface 16 and concave front surface 20 re-shapes an incoming collimated light beam and re-direct it through a smaller opening at the concave front surface 20. As shown in FIG. 9, the central optical axis of radiation 34 from each of the reflectors is generally parallel along the curve length 40.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle lamp comprising:

a projection lens having a lens profile with a rear major surface with a convex curvature and a front major surface with a concave curvature, wherein a rear height of the rear major surface is greater than a front height of the front major surface;

a plurality of light sources;

a reflector configured to reflect the light emitted from the plurality light of sources towards the projection lens; and wherein as the lens profile is swept along a curve length, at least one of the rear convex curvature or the front concave curvature varies, and wherein the light output from the front major surface of the projection lens is generally uniform along the curve length.

2. The vehicle lamp of claim 1 wherein the front height is less than a profile thickness between the rear major surface and the front major surface.

3. The vehicle lamp of claim 1 wherein a profile thickness between the rear major surface and the front major surface is generally constant.

4. The vehicle lamp of claim 1 wherein a profile thickness between the rear major surface and the front major surface varies along the curve length.

5. The vehicle lamp of claim 1 wherein the front height is generally constant along the curve length.

6. The vehicle lamp of claim 1 wherein the curve length has at least one of a rake curvature and a sweep curvature.

7. The vehicle lamp of claim 1 wherein the convex curvature extends in a height direction, wherein the major rear surface further comprises a plurality of tailored contours extending in a length direction of the curve length.

8. The vehicle lamp of claim 7 wherein the plurality of tailored contours is shaped as a plurality of scallops.

9. The vehicle lamp of claim 1 wherein the plurality of light sources comprises a plurality of light emitting diodes (LEDs) spaced apart in a length direction of the curve length.

10. The vehicle lamp of claim 9 within the reflector comprises a plurality of reflectors, wherein one of the reflectors is positioned adjacent each of the LEDs.

11. The vehicle lamp of claim 10 wherein the central optical axis of radiation from each of the reflectors is generally parallel along the curve length.

12. A vehicle lamp comprising:

a light blade having a convex rear surface to redirect and reshape a light input towards a concave front surface, the light blade having, a front height less than a rear height;

a light source disposed rearward of the light blade; and a reflector configured to reflect light emitted from the light source towards the light blade, wherein a light output from the concave front surface of the light blade is generally uniform along a blade length.

13. The vehicle lamp of claim 12 wherein a convex curvature of the rear convex surface varies along the blade length while a concave curvature of the concave front surface remains constant.

14. The vehicle lamp of claim 12 wherein the blade length has at least one of a rake curvature and a sweep curvature.

15. The vehicle lamp of claim 12 wherein the front height is less than a profile thickness between the convex rear surface and the concave front surface.

* * * * *